US006510861B1

(12) United States Patent
Mead

(10) Patent No.: US 6,510,861 B1
(45) Date of Patent: Jan. 28, 2003

(54) UNIVERSAL GOLF UMBRELLA

(76) Inventor: Harvey F. Mead, 13829 W. 58th Ter., #4, Shawnee, KS (US) 66216

( * ) Notice: Subject to any disclaimer, the term of this patent is extended or adjusted under 35 U.S.C. 154(b) by 73 days.

(21) Appl. No.: 09/672,683

(22) Filed: Sep. 28, 2000

Related U.S. Application Data

(60) Provisional application No. 60/158,972, filed on Oct. 12, 1999.

(51) Int. Cl.[7] ..... A45B 3/00; A63B 47/02

(52) U.S. Cl. ..... 135/16; 294/19.2

(58) Field of Search ..... 135/15.1, 16, 17, 135/19, 19.5, 25.1, 48, 98; 473/286; 294/19.2

(56) References Cited

U.S. PATENT DOCUMENTS 1,807,686 A * 6/1931 Bright ..... 135/16
3,999,243 A * 12/1976 La Pour ..... 473/282
4,214,770 A 7/1980 Agins
4,733,681 A 3/1988 Lee
4,790,338 A 12/1988 Strobl
5,167,247 A 12/1992 Belmonte
5,261,434 A 11/1993 Fodero
5,476,113 A 12/1995 Lin et al.
5,505,645 A * 4/1996 Engler, Jr. ..... 135/16
5,687,946 A * 11/1997 Cho ..... 248/530
6,095,168 A * 8/2000 Berges ..... 135/16
6,409,611 B1 * 6/2002 Louk, Jr. ..... 135/16

* cited by examiner

*Primary Examiner*—Michael Safavi
(74) *Attorney, Agent, or Firm*—Chase Law Firm, L.C.

(57) ABSTRACT

A golfing accessory apparatus employs a longitudinally extensible and retractable pole upon which an umbrella unit is mounted for use in the usual fashion when an umbrella is desired. Mounts on both the handle end and the opposite end of the umbrella pole provide a means of attaching any one of a number of accessory devices as desired for the convenience and pleasure of a golfer. When used as a golf ball retriever, the umbrella unit may be completely removed from the pole so as not to impede use of the device for retrieval purposes.

14 Claims, 6 Drawing Sheets

UNIVERSAL GOLF UMBRELLA

CROSS-REFERENCE TO RELATED ART

This application claims the benefit of the prior filed, provisional application Ser. No. 60/158,972, filed Oct. 12, 1999.

BACKGROUND OF THE INVENTION

This invention relates to a multi-purpose golf umbrella and, in particular, to a golf umbrella in which the umbrella unit may be removed from its supporting shaft to enable the shaft to be more effectively utilized as a ball retriever or for other purposes, and which has the capability of accommodating various accessory devices for the convenience and pleasure of a golfer.

Golf ball retrievers have been incorporated into umbrellas in an effort to provide the golfer with a dual purpose unit that may be conveniently attached to a golf bag during play. However, such devices can be awkward to use as a retriever due to the presence of the umbrella frame and canopy on the supporting shaft, which must be extended to a significant length for retrieval purposes. This is particularly the case when attempting to retrieve a ball from a water hazard in situations where the ball is difficult to reach.

Furthermore, such prior art devices do not provide a full range of accessories that are useful to the golfer during play, such as an adaptor for holding a score card, a seat for the player when delays are encountered, and the ability to support and accommodate other accessory devices that a golfer may wish to use during play.

It is, therefore, the primary object of the present invention to provide a golf umbrella which may be used for various purposes other than to protect a golfer from sun and rain, and in which an important characteristic of the apparatus is the ability to remove the umbrella unit from its supporting shaft for functions where the presence of the umbrella unit would render the device cumbersome and awkward to operate.

Another important object of the invention is to provide a golf umbrella as aforesaid having an extensible shaft to which a ball-retrieving cup may be attached, wherein the umbrella unit may be temporarily removed from the shaft during use of the device as a retriever.

Still another important object is to provide such an apparatus which may be employed as an umbrella or as an extensible pole, with or without the umbrella, to which an accessory is secured.

Still another important object is to provide such an apparatus having a handle on the shaft thereof which accommodates the addition of an accessory device to the handle at the option of the user, whereby the apparatus may be employed as an umbrella or as a support to which an accessory is secured.

Still another important object is to provide such an apparatus in which the handle may be removed from the umbrella shaft and used exclusively as a handle for an accessory tool connected thereto, such as a brush for cleaning golf shoes and club heads, or a wrench for tightening or loosening spikes.

Furthermore, it is an important object of the present invention to provide a golf umbrella to which a weighted head may be secured at the option of the user, in a manner such that the apparatus may be employed as a warm-up club.

Yet another important object is to provide a golf umbrella that may also serve as a support or stand for a score card adaptor or a seat for use by the golfer during delays in play.

Other objects will become apparent as the detailed description proceeds.

DESCRIPTION OF THE PREFERRED EMBODIMENT

Figure 1:
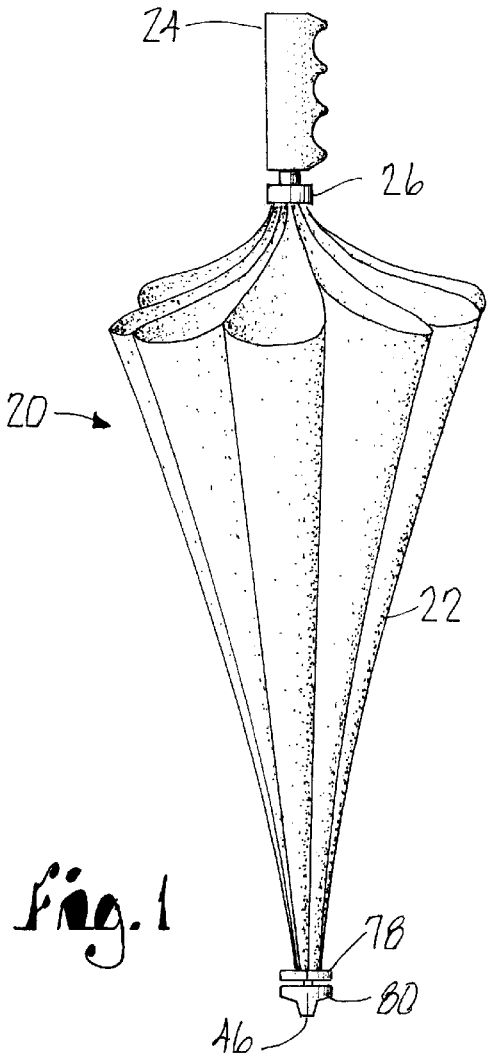
FIG. 1 is an elevational view of the golfing accessory apparatus of the present invention, showing the umbrella in a closed condition and in an inverted orientation with the handle at the top.
Figure 2:
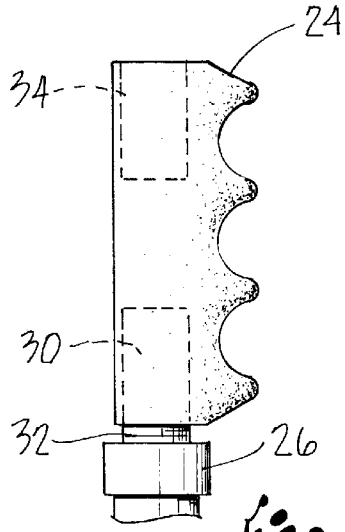
FIG. 2 is an enlarged, fragmentary view of the handle of the apparatus showing the internal threads used for removably securing the handle to the shaft and which provide a connection for attaching an accessory device (not shown).
Figure 3:
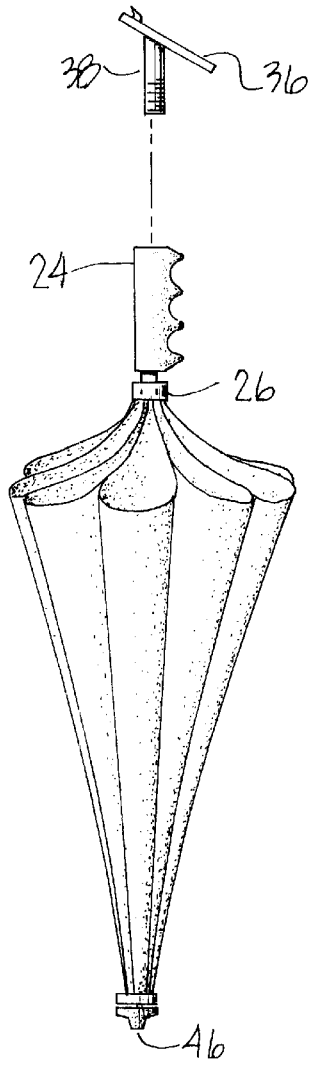
FIG. 3 is an exploded view similar to FIG. 1 but showing a score card adaptor secured to the handle.
Figure 4:
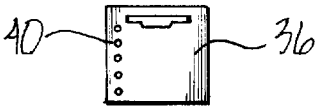
FIG. 4 is a plan view of the score card adaptor seen in FIG. 3.

Referring initially to FIGS. 1–8, the golfing apparatus of the present invention employs an umbrella unit 20 having the usual canopy 22 shown closed in FIGS. 1 and 3. The umbrella unit 20 is inverted and thus a handle 24 is seen at the top joined to a collar 26 on the adjacent end of the umbrella pole 28 (FIG. 9) to be discussed hereinbelow. The handle 24 has an elongated grip configuration and is provided with a tapped opening 30 in its lower end (as viewed in FIG. 2) that receives a threaded stud 32 integral with collar 26 and projecting axially therefrom. A similar, aligned tapped opening 34 at the opposite end of handle 24 serves as a connection for an accessory device that, once mounted on handle 24, is supported by the umbrella apparatus which typically is secured to a golf bag and thus, when carried in a golf cart, would be in the inverted, upright position shown in FIGS. 1 and 3.

The exploded view of FIG. 3 illustrates use of the apparatus to support an accessory device, a score card adaptor 36 being shown provided with a depending, threaded connector 38 received in the mating threaded opening 34 in handle 24. It should be noted in FIG. 2 that reverse threads are used in the handle openings or receptacles 30 and 34.

The adaptor 36 is a small clip board for holding a score card (not shown) and would typically be provided with a pencil holder and a row of grommet holes 40 for holding golf tees. Accordingly, the score card is held in the adaptor 36 at a location adjacent the top of the golf bag (not shown) where it may be conveniently used to keep score during play.

Figure 5:
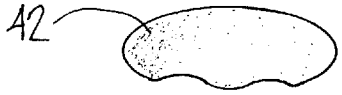
FIG. 5 is a plan view of a seat which may be supported by the apparatus as in FIG. 3 in place of the score card adaptor.
Figure 6:
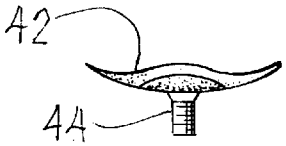
FIG. 6 is an elevational view of the seat of FIG. 5 and shows the threaded connector beneath the seat which is received by the handle of the apparatus.

Another accessory device is shown in FIGS. 5 and 6 and comprises a padded seat 42 having a threaded connector 44 projecting from the bottom thereof which mates with the threaded opening 34 in handle 24. This accessory would be used with the umbrella apparatus detached from the golf bag with its tip 46 resting on the ground, thereby providing a stand to support the seat 42 for use by the golfer during delays in play.

Figure 7:
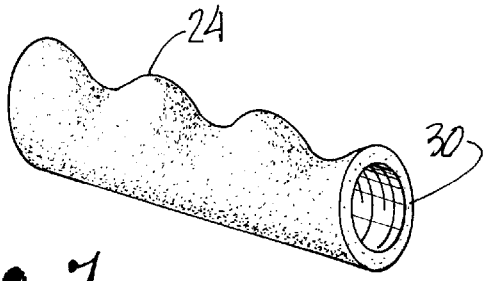
FIG. 7 is an enlarged, perspective view of the handle showing the internal threads at one end which releasably secure the handle to the umbrella shaft.
Figure 8:
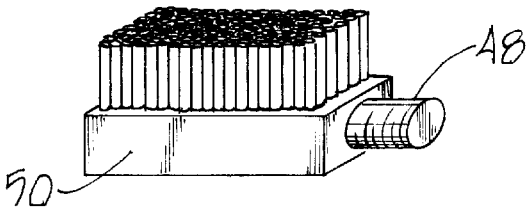
FIG. 8 is a perspective view of a brush which may be attached to the handle of FIG. 7 when the handle is removed from the umbrella shaft.
Figure 9:
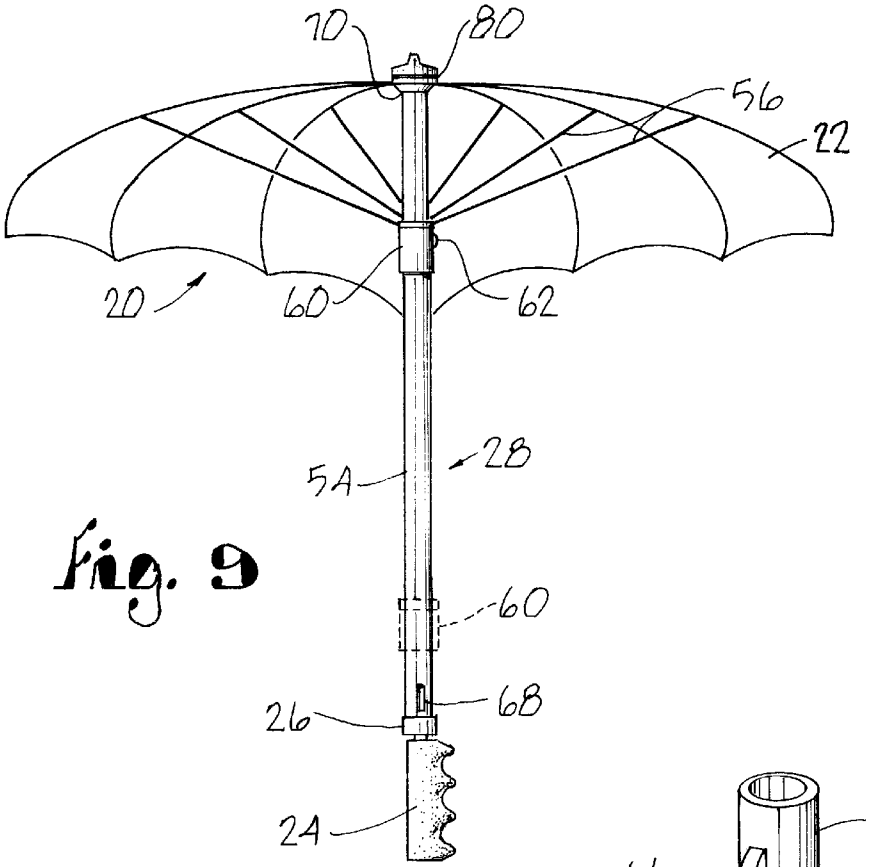
FIG. 9 is an elevational view of the apparatus showing the umbrella open, the canopy being broken away to reveal the pole and sliding collar components, the broken lines illustrating the position of the collar when the umbrella is closed.
Figure 17:
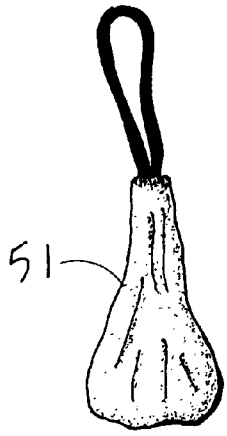
FIG. 17 is an illustration of an accessory bag for the various accessory devices that may be used with the apparatus, such as those shown in FIGS. 4, 8, 14 and 15.

The handle 24 may also be removed from stud 32 and used separately as a handle for an accessory device connected thereto as illustrated in FIGS. 7 and 8. The detached handle 24 can be used with any of a number of such devices, each of which would be provided with an externally threaded connector as shown at 48 projecting from a brush 50. Part 48 and opening 30 having mating threads so that handle 24 may be readily joined to brush 50 and the same used for cleaning golf shoes, club heads and other things as desired. Other tools can likewise be provided such as a spike wrench (not shown) for tightening or removing spikes from the user's golf shoes. These tools and accessories in non-use may be conveniently stored in an accessory bag 51 illustrated in FIG. 17.

Figure 10:
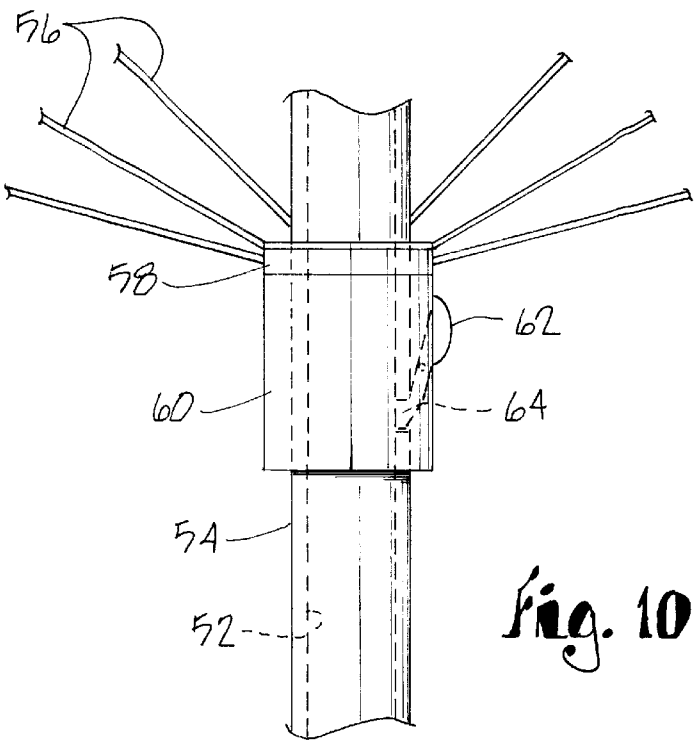
FIG. 10 is an enlarged, fragmentary elevational view of the collar and associated frame components of the umbrella when the canopy is open.
Figure 11:
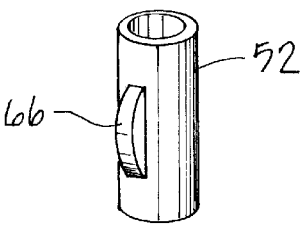
FIG. 11 is a detail showing the spring-loaded catch on the inner umbrella shaft that locks the inner and outer shafts together when retracted as in FIG. 9.

Referring to FIGS. 9–12, the structure and operation of the umbrella unit 20 is shown. The pole 28 comprises a pair of tubular, telescoped, inner and outer shafts 52 and 54 respectively which are fully retracted in FIGS. 9, 10 and 12. In addition to the canopy 22, the umbrella unit 20 includes a conventional supporting frame that includes hinged ribs 56 radiating from a lower support ring 58 on a sliding collar 60 that receives outer shaft 54 and is moveable therealong to the full line position shown in FIGS. 9 and 10 where the umbrella is open, and the broken line position shown in FIG. 9 where the canopy 22 would be closed. As illustrated in FIG. 10, a button 62 on collar 60, when depressed, swings a dog 64 against the bias of an internal spring (not shown) free of an opening in the wall of outer shaft 54 to release the umbrella and permit the sliding collar 60 to be shifted to the broken line position (as is conventional in umbrellas).

Until released, the inner and outer shafts 52 and 54 are locked against longitudinal movement by a spring-loaded catch 66 (FIG. 11) mounted in the wall of the inner shaft 52 and aligned with a slot 68 (FIG. 9) in the outer shaft 54. Accordingly, the pole 28 comprising shafts 52 and 54 cannot be extended until catch 66 is depressed so as to clear the slot 68.

Figure 12:
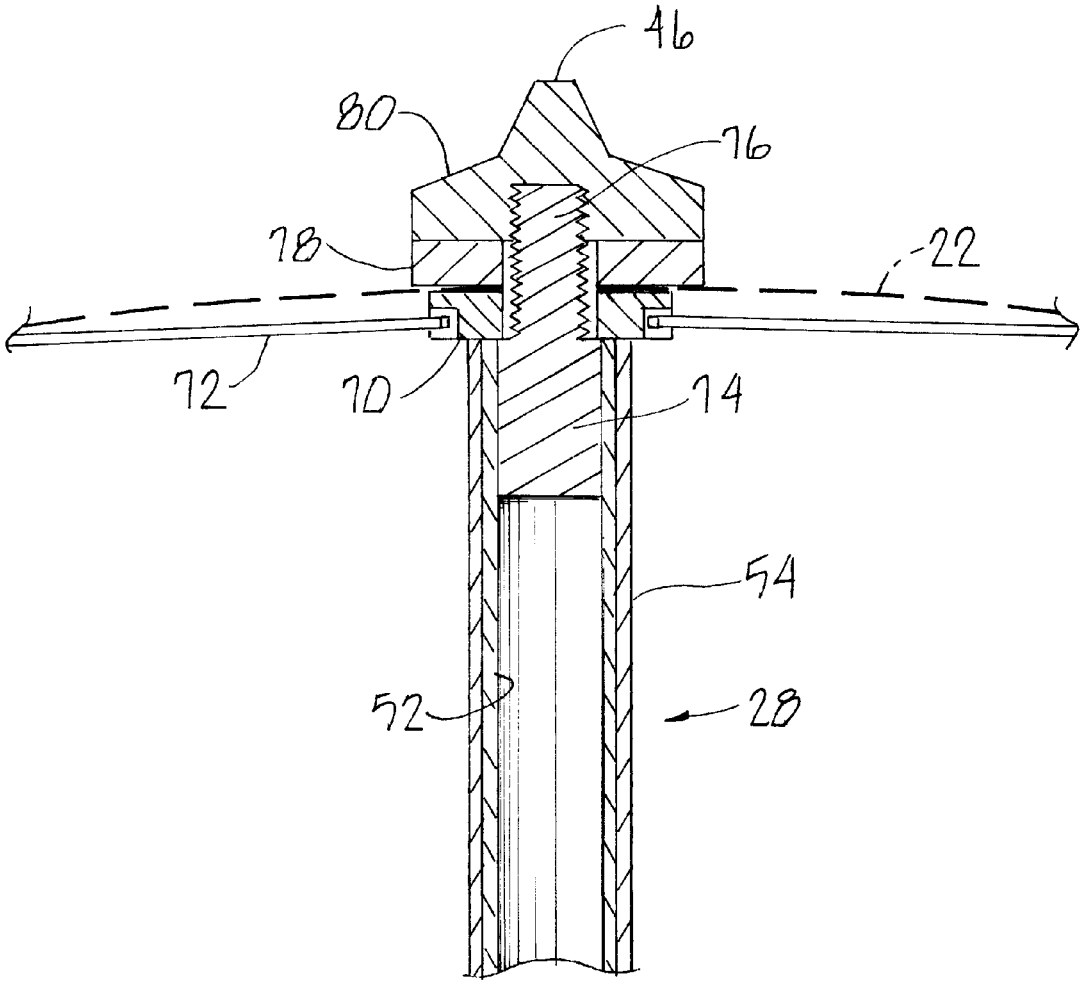
FIG. 12 is an enlarged, fragmentary, vertical cross-sectional view of the upper end of the umbrella pole as seen in FIG. 9, showing the retainer releasably securing the umbrella unit to the inner shaft.

The umbrella frame also includes an upper support ring 70 which is fixed at the top of the pole 28 as shown in detail in FIG. 12. A plurality of ribs 72 radiate therefrom and underlie the canopy 22. An insert 74 secured within the upper end of inner shaft 52 has an integral, axially outwardly extending threaded element 76 which extends coaxially through ring 70 and projects thereabove. A retainer comprising a washer 78 and an internally threaded cap 80 is secured over element 76 and tightened in place to hold upper ring 70 on the upper end of the pole 28. As will be appreciated hereinbelow, the threaded element 76 provides the mounting means for accessory devices when exposed by unscrewing and removing cap 80. Removal of the cap 80 and washer 78 also permits the entire umbrella unit 20 to be removed from the pole 28 during accessory uses when the presence of the umbrella is not desired. Reinstallation of the umbrella unit 20 is readily accomplished by simply sliding the collar 60 over the outer shaft 54 and placing the upper ring 70 over the threaded element 76, and replacing washer 78 and cap 80.

Figure 13:
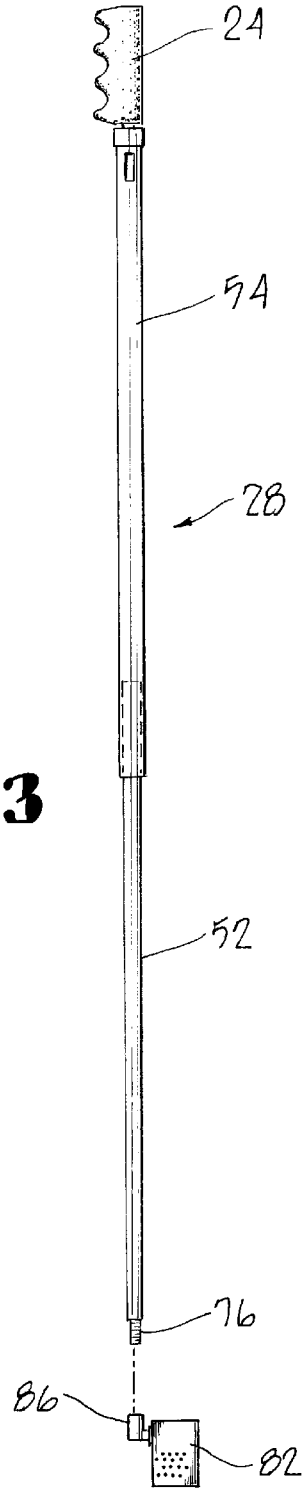
FIG. 13 is an exploded view of the apparatus with the umbrella unit removed and the inner shaft extended, to which a ball retriever cup is mounted.

FIG. 13 illustrates an accessory use where the umbrella unit 20 is removed from the pole 28. The telescoping shafts 52 and 54 are fully extended and held by a conventional internal twist lock (not shown),which engages when the shafts 52 and 54 are rotated in opposite directions. A ball retriever cup 82 has openings 84 in its wall so it will not hold water and is mounted on the end of an L-shaped connecting arm 86 which is internally threaded to receive element 76 at the end of shaft 52. Preferably, a swivel connector (not shown) would be provided on the end of arm 86 that connects to cup 82 to provide a swivel joint that permits cup 82 to maintain an orientation as shown with its mouth 88 opening upwardly for easier retrieval of a ball. As may be appreciated from FIG. 13, the extended pole 28, being free of the umbrella unit 20, may be easily manipulated for retrieval of a ball from a water hazard.

Figure 15:
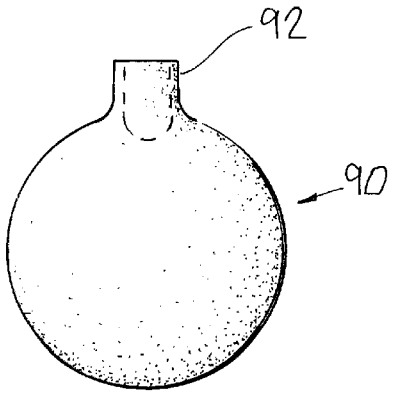
FIG. 15 shows a metal ball with an internally threaded neck.
Figure 14:
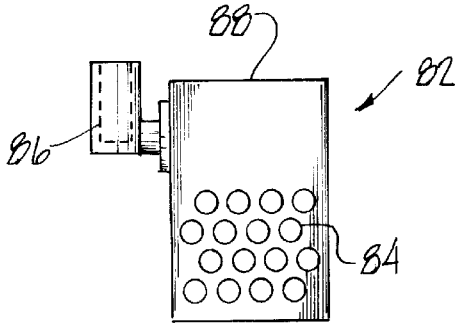
FIG. 14 is an elevational view of the retriever cup.
Figure 16:
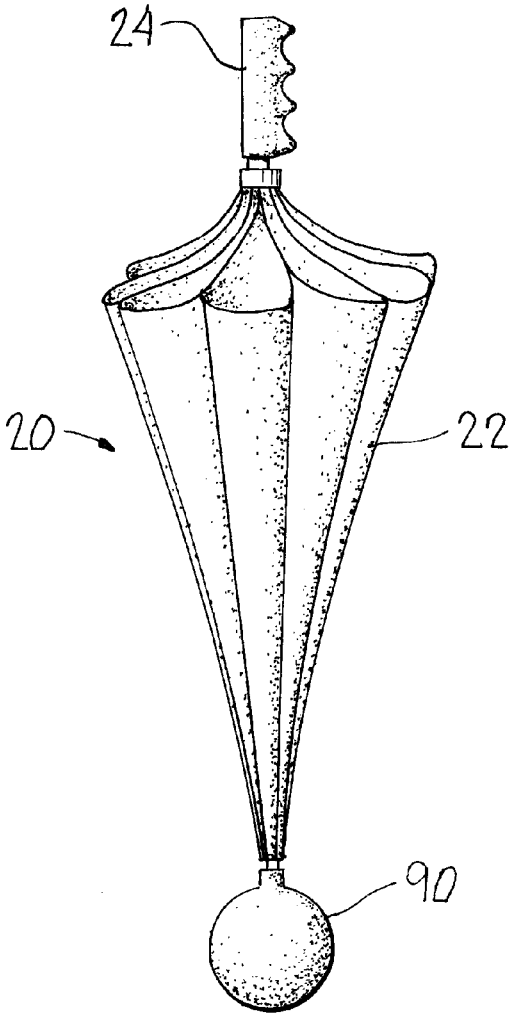
FIG. 16 shows the ball attached to the end of the umbrella apparatus opposite the handle to provide a weighted warm-up club.

The threaded mounting element 76 on the end of inner shaft 52 may also be used as a mount for other accessory devices, such as a metal ball 90 as shown in FIGS. 15 and 16. The neck 92 of the ball is tapped to receive threaded element 76. As illustrated in FIG. 16, this provides a warm-up club for the golfer as the metal ball provides a weighted head and the presence of the closed canopy 22 adds air resistance to the swing. In this use, of course, the retaining cap 80 is removed from element 76 and the ball 90 mounted thereon, but the umbrella unit 20 remains in place.

From the foregoing it may be appreciated that the present invention is capable of providing a number of accessory uses for the umbrella apparatus due to its versatility achieved by providing mounts for accessory devices at both ends of the umbrella pole and the capability, as discussed above, of completely removing the umbrella unit from the apparatus when desired. It should also be appreciated that the apparatus could employ additional telescoping shaft sections, such as a three-stage, telescoping pole if additional extension is desired particularly for ball retrieval applications.

Having thus described the invention, what is claimed as new and desired to be secured by Letters Patent is as follows:

1. A golfing accessory apparatus comprising:

a longitudinally extensible and retractable pole having first and second ends and including a pair of telescoping, inner and outer shafts presenting said first and second ends respectively, an umbrella unit including a canopy and supporting frame, mounting means on said inner shaft at said first end of the pole, releasable retaining means securing said frame to said mounting means for movement of the umbrella unit along the pole between open and closed positions, and upon release of said retaining means permitting removal of said umbrella unit from said pole, a handle on said outer shaft at said second end of the pole, an accessory device, and means for securing said accessory device to said mounting means at the option of the user, whereby the apparatus may be employed as an umbrella or as an extensible pole, with or without the umbrella, to which an accessory is secured.

2. The apparatus as claimed in claim 1, wherein said mounting means includes a threaded element extending axially outwardly from said inner shaft at said first end of the pole, said releasable retaining means being engageable with said element to selectively hold the umbrella unit on the pole or permit removal therefrom.

3. The apparatus as claimed in claim 2, wherein said frame includes a fixed support ring receiving said element and engaged by said retaining means when the umbrella unit is mounted on the pole.

4. The apparatus as claimed in claim 1, wherein said accessory device comprises a cup for retrieving a golf ball from a water lie.

5. The apparatus as claimed in claim 1, wherein said accessory device comprises a weighted head whereby the apparatus may be used as a warm-up club.

6. A golfing accessory apparatus comprising:

an umbrella unit including a canopy and supporting frame movable along a shaft between open and closed positions, said shaft presenting an outer end portion, a handle on said end portion, an accessory device comprising a brush for cleaning golf shoes, club heads and other items, and means for connecting said accessory device to the handle at the option of the user, whereby the apparatus may be employed as an umbrella or as a support to which the accessory device is secured, said handle including means for releasably securing the handle to said end portion, whereby the handle may be removed from the umbrella shaft and used exclusively as a handle for the accessory device.

7. A golfing accessory apparatus comprising:

a longitudinally extensible and retractable pole having first and second ends and including a pair of telescoping, inner and outer shafts, an umbrella unit including a canopy and supporting frame, a mounting element on said first end of the pole, a removable retainer engageable with said mounting element for securing said frame on the pole for movement of the umbrella unit along the pole between open and closed positions, and upon removal of said retainer permitting removal of said umbrella unit from said pole, a handle on said outer shaft at said second end of the pole, an accessory device, and means for securing said accessory device to one of said shafts at one of said ends at the option of the user, whereby the apparatus may be employed as an umbrella or as an extensible pole, with the umbrella removed, to which an accessory is secured.

8. The apparatus as claimed in claim 7, wherein said accessory device is a score card adaptor.

9. The apparatus as claimed in claim 7, wherein said accessory device is a seat.

10. The apparatus as claimed in claim 7, wherein said handle includes means for releasably securing the handle to said second end, whereby the handle may be removed from the outer shaft and used exclusively as a handle for an accessory connected thereto.

11. The apparatus as claimed in claim 10, wherein said handle is elongated and presents a pair of ends, each of said handle ends being threaded to provide said releasable securing means, there being mating thread means on said accessory device and said second end.

12. The apparatus as claimed in claim 10, wherein said accessory device is a brush for cleaning golf shoes, club heads and other items.

13. The apparatus as claimed in claim 7, wherein said accessory device comprises a weighted head whereby the apparatus may be used as a warm-up club.

14. The apparatus as claimed in claim 7, wherein said accessory device comprises a cup for retrieving a golf ball from a water lie, said cup presenting a mouth for receiving balls and a foraminous wall for retaining retrieved balls while precluding water retention.

* * * * *